US011794199B2

(12) United States Patent
Meshberg et al.

(10) Patent No.: US 11,794,199 B2
(45) Date of Patent: Oct. 24, 2023

(54) FOLDING EXTENSION NOZZLE AND DISPENSING ASSEMBLY

(71) Applicant: Packaging Concepts Associates Holding, Inc., Torrington, CT (US)

(72) Inventors: Emil Meshberg, Fairfield, CT (US); Henry W. Delaney, Jr., North Branford, CT (US)

(73) Assignee: PACKAGING CONCEPTS ASSOCIATES HOLDING, INC., Torrington, CT (US)

( * ) Notice: Subject to any disclaimer, the term of this patent is extended or adjusted under 35 U.S.C. 154(b) by 0 days.

(21) Appl. No.: 17/580,590

(22) Filed: Jan. 20, 2022

(65) Prior Publication Data

US 2023/0226564 A1 Jul. 20, 2023

(51) Int. Cl.

| | |
|---|---|
| ***B05B 3/04*** | (2006.01) |
| ***B05B 3/10*** | (2006.01) |
| ***B05B 11/00*** | (2023.01) |

(52) U.S. Cl.

CPC ..... *B05B 3/0409* (2013.01); *B05B 3/1007* (2013.01); *B05B 11/0091* (2013.01)

(58) Field of Classification Search

CPC ..... B05B 11/0091
USPC ..... 222/526–537, 321.9
See application file for complete search history.

(56) References Cited

U.S. PATENT DOCUMENTS 692,152 A 1/1902 Kreps
731,454 A * 6/1903 Higgins ..... B65D 90/54 222/533
1,534,173 A * 4/1925 Fogelberg ..... F16N 3/12 222/533
1,567,476 A * 12/1925 Voight ..... F16N 3/04 222/533
1,607,495 A * 11/1926 Wiking ..... F16N 3/08 222/533
2,758,874 A 8/1956 Snyder
2,968,441 A 1/1961 Holcomb
(Continued)

FOREIGN PATENT DOCUMENTS

WO 2013096809 A2 6/2013

OTHER PUBLICATIONS https://shop.pipebreakusa.com/pipe-break—9-oz-can-with-attached-straw-single-can-p2.aspx, Oct. 7, 2021 (2 pages).
(Continued)

*Primary Examiner* — Paul R Durand
*Assistant Examiner* — Michael J. Melaragno
(74) *Attorney, Agent, or Firm* — Ware, Fressola, Maguire & Barber LLP

(57) ABSTRACT

A dispensing nozzle and a dispensing assembly incorporating the dispensing nozzle are provided. The dispensing assembly comprises a cap body, a dispenser actuator, and a dispensing nozzle. The dispensing nozzle comprises a nozzle base having a mounting end configured to be mounted to the dispenser actuator; and a nozzle body connected, at a connection joint, to a distal end of the nozzle base. The connection joint includes a first surface having an arcuate slot and a second surface opposing the first surface, which may include a post, the arcuate slot being configured to receive the post. The post is configured to pass through the arcuate slot such that the nozzle body is configured to rotate about the nozzle base.

13 Claims, 13 Drawing Sheets

(56) References Cited

U.S. PATENT DOCUMENTS 3,058,670 A 10/1962 Marotto
3,116,856 A 1/1964 Prussin
3,148,806 A * 9/1964 Meshberg ..... B65D 83/205 239/587.5
3,272,406 A 9/1966 Lehmann
3,937,585 A * 2/1976 Cattermole ..... H01R 4/60 403/321
4,009,664 A * 3/1977 Fearon ..... B61D 7/26 222/536
4,234,127 A * 11/1980 Tada ..... B05B 11/3059 222/533
4,512,501 A * 4/1985 Foster ..... B05B 11/3001 222/321.9
4,611,759 A 9/1986 Cox
4,706,663 A 11/1987 Makiej
4,775,081 A 10/1988 Morane
4,858,792 A 8/1989 de Laforcade
4,925,106 A 5/1990 Maas et al.
5,152,425 A * 10/1992 Baudin ..... B05B 11/3057 222/404
5,176,654 A 1/1993 Schreiber
5,271,538 A * 12/1993 Lipker ..... B65D 47/065 222/536
5,381,932 A * 1/1995 Humphrey ..... A47G 19/183 222/321.9
5,615,809 A 4/1997 Feer et al.
5,678,765 A 10/1997 Dobbs et al.
6,105,826 A * 8/2000 Oursin ..... B05B 11/0091 222/402.1
6,109,547 A * 8/2000 Ritsche ..... B05B 11/0005 222/22
6,158,631 A * 12/2000 Varini ..... B67D 7/42 222/536
6,186,364 B1 * 2/2001 Dobbs ..... B05B 11/3059 222/321.9
6,513,684 B1 * 2/2003 Bougamont ..... B65D 83/56 222/548
6,615,826 B1 9/2003 Gabrio et al.
6,691,896 B2 2/2004 Meshberg
6,705,538 B2 3/2004 Fecht et al.
6,732,958 B2 5/2004 Norville et al.
6,796,462 B2 9/2004 Hudson et al.
6,932,244 B2 8/2005 Meshberg
7,025,232 B2 * 4/2006 Green ..... B05B 11/0091 222/533
7,070,072 B2 7/2006 Bonham
7,097,078 B2 8/2006 Sanchez
7,107,987 B2 9/2006 Sundaram et al.
7,137,537 B2 11/2006 Rueschhoff et al.
7,222,802 B2 5/2007 Sweeton
7,261,103 B2 8/2007 Katz
7,434,707 B2 10/2008 Meshberg
7,597,276 B2 10/2009 Hawkins
7,600,701 B2 10/2009 Jasper et al.
7,931,175 B2 4/2011 Hjort
8,668,106 B1 * 3/2014 Joy ..... A47G 19/2272 220/717
8,777,061 B1 * 7/2014 Meshberg ..... B05B 11/3059 222/402.11
9,981,787 B2 5/2018 Peuker et al.
10,370,176 B2 8/2019 Starzman et al.
10,464,736 B1 11/2019 Pindor et al.
10,654,051 B2 5/2020 Meshberg
10,669,082 B1 * 6/2020 Meshberg ..... B65D 43/16
10,689,169 B1 6/2020 Meshberg et al.
11,040,809 B1 6/2021 Meshberg
D929,228 S 8/2021 Takizawa
D929,229 S 8/2021 Pindor et al.
2003/0047571 A1 * 3/2003 Ramsey ..... B05B 11/3077 222/321.9
2008/0041894 A1 * 2/2008 Schliemann ..... B05B 11/3001 222/321.9
2008/0264981 A1 * 10/2008 Hjort ..... B05C 17/00596 222/533
2010/0192946 A1 8/2010 Oi et al.
2011/0101130 A1 * 5/2011 Tseng ..... B05B 11/0091 222/321.9
2012/0305604 A1 * 12/2012 Wang ..... B05B 11/3074 222/321.9
2018/0023273 A1 * 1/2018 Mosley ..... E03B 7/08 285/31
2018/0214894 A1 * 8/2018 Meshberg ..... B05B 1/02
2018/0221601 A1 8/2018 Meshberg

OTHER PUBLICATIONS https://www.etsy.com/listing/550727129/powder-spray-bottle-with-locking-nozzle?gpla=1&gao=1& 3/, Oct. 7, 2021 (2 pages).

* cited by examiner

SECTION A-A

SECTION B-B

SECTION F-F

SECTION G-G

FOLDING EXTENSION NOZZLE AND DISPENSING ASSEMBLY

FIELD OF THE INVENTION

The present application relates to a foldable nozzle for use with a fluid dispensing assembly.

BACKGROUND OF THE DISCLOSURE

A typical nozzle type dispensing bottle includes a nozzle which extends horizontally, perpendicularly from the bottle. This feature can make the bottle more difficult to package and transport, as the bottle with projected nozzle occupies a greater volume than just the bottle itself. Additionally, such nozzle-type dispensers typically do not include any child-resistant locking mechanism or may include a locking mechanism that is overly complicated and too difficult for some elderly patients to open. What is needed is an improved dispensing nozzle for a container that addresses these shortcomings in the art.

SUMMARY OF THE DISCLOSURE

The present disclosure relates to a foldable nozzle extension and a spray bottle incorporating the same, and which spray bottle may further include a child resistant locking system which uses an automatic locking element and requires a rotation of parts from a dispense-disabled position to a dispense-enabled position after unlocking the locking means.

The unfolding extension dispenser may include: a nozzle base, a folding nozzle, a spray inserts, a child resistant actuator, a child resistant locking button, a cap, a pump, and a bottle. The folding nozzle is connected to the nozzle base, such that the nozzle can rotate between an extended position allowing dispensing a substance through the nozzle, and a folded position that is perpendicular to the extended position, where the nozzle can be folded down for packaging.

During normal operation, the top of bottle can be depressed to dispense a substance from the bottle through the nozzle. The dispenser may further include a child resistant locking mechanism that allows for the dispenser to be locked and prevented from dispensing the substance in the bottle. The actuator may include a tab or extension opposite the dispenser that, when the dispenser is unlocked, can be depressed downward to enable the spraying action, in which the nozzle base and folding nozzle are also depressed downward. The actuator can be rotated, which brings the tab into abutment with a raised wall on the cap, which prevents the tab of the actuator from being depressed. Upon this rotation, the nozzle base is also placed into abutment with a second raised wall on the cap.

The child resistant locking mechanism of the dispenser may also include a child resistant button, and when the actuator is in the in the opened position, the button is retained within the cap. When the actuator is rotated into the locked position, the button is allowed to project out of the cap, and interferes with an edge on the cap, at rest, such that the actuator cannot rotate back to the open position unless the button is manually depressed while the actuator is simultaneously being rotated.

One general, first aspect of the present application provides for a dispensing nozzle. The dispensing nozzle comprises a nozzle base having a mounting end configured to be mounted to a structure, and a nozzle body having a first end connected, at a connection joint, to a distal end of the nozzle base, the distal end being opposite the mounting end. The connection joint may include a first surface having an arcuate slot formed therein and a second surface opposing the first surface having a post projecting therefrom, the arcuate slot being configured to receive the post therein. The post is configured to pass through the arcuate slot such that the nozzle body is configured to rotate about the nozzle base. The dispensing nozzle further comprises dispenser arranged at a second end of the nozzle body, having an opening for dispensing a substance.

Implementations of this first aspect of the present application may include one or more of the following features. The nozzle body can be configured to rotate between a first position in which the nozzle body is substantially parallel to the nozzle base and a second position in which the nozzle body is substantially perpendicular to the nozzle base. The first surface may be disposed on the first end of the nozzle body and the second surface disposed on the distal end of the nozzle base. The nozzle body and nozzle base each may include a channel formed therethrough, and the distal end of the nozzle base may include a cylindrical extension formed on the second surface may include an intermediary channel formed therein configured to connect the nozzle body channel and the nozzle base channel; and wherein the first end of the nozzle body may include a cavity formed therein to receive the cylindrical extension therein. The distal end of the nozzle base, the first end of the nozzle body, the first surface, and the second surface may each be beveled. The arcuate slot can be substantially semi-circular. The nozzle body may be configured to rotate between a first position in which the nozzle body is substantially parallel to the nozzle base and a second position in which the nozzle body is substantially perpendicular to the nozzle base. The first end of the nozzle body may include a circumferential clamping member and the distal end of the nozzle base may include a circumferential edge, wherein the circumferential clamping member is configured to engage the circumferential edge. In various embodiments, the distal end of the nozzle base, the first end of the nozzle body, the first surface, and the second surface are beveled, the arcuate slot is substantially semi-circular and includes two ends, each end may include a rounded stop member, and each rounded stop member configured to retain the post.

A second general aspect of the present application provides for a dispensing assembly. The dispensing assembly comprises a cap body; a dispenser actuator arranged at least partly within the cap body; and a dispensing nozzle. The dispensing nozzle comprises a nozzle base having a mounting end configured to be mounted to the dispenser actuator; and a nozzle body having a first end connected, at a connection joint, to a distal end of the nozzle base, the distal end being opposite the mounting end. The connection joint may include: a first surface having an arcuate slot formed therein; and a second surface opposing the first surface, which may include a post projecting therefrom, the arcuate slot being configured to receive the post therein. The post is configured to pass through the arcuate slot such that the nozzle body is configured to rotate about the nozzle base. The nozzle further comprises a dispenser arranged at a second end of the nozzle body including an opening for dispensing a substance.

Implementations of the second general aspect of the application may include one or more of the following features. The first surface may be disposed on the first end of the nozzle body and the second surface disposed on the distal end of the nozzle base. The distal end of the nozzle base, the first end of the nozzle body, the first surface, and the second surface may each be beveled and the arcuate slot is substantially semi-circular; and the nozzle body configured to rotate between a first position in which the nozzle body is substantially parallel to the nozzle base and a second position in which the nozzle body is substantially perpendicular to the nozzle base. The dispenser actuator may be configured to be depressed into the cap body and cause a corresponding depression of the dispensing nozzle connected to the dispenser actuator and enables dispensing of a substance through the dispensing nozzle. The dispensing assembly may include a container connected to the cap body and configured to house the substance to be dispensed by the dispensing assembly. The cap body may include: an upstanding wall having: a vertical channel formed therein being disposed adjacent to the nozzle base to permit depression of the dispensing nozzle through the vertical channel upon depression of the dispenser actuator. The cap body may also include a horizontal channel formed therein adjacent and perpendicular to the vertical channel. The dispenser actuator is configured for rotational movement about a longitudinal axis of the dispensing assembly, and the dispenser actuator is configured to rotate to position the nozzle base in the horizontal channel and the horizontal channel prevents depression of the nozzle base and dispenser actuator. The cap body may include an upstanding wall having an actuation enabling clearance formed therein; and the dispenser actuator may include an actuating surface having a projecting tab extending from an edge of the actuating surface and aligned with the actuation enabling clearance, wherein the projecting tab is configured to pass through the actuation enabling clearance when the dispenser actuator is depressed. The upstanding wall may include an actuator limit stop positioned in arcuate alignment with the actuation enabling clearance; and the dispenser actuator configured for rotational movement between a first position in which the projecting tab is aligned with the actuation enabling clearance and a second position in which the projecting tab is aligned with the actuator limit stop, where in the second position, the actuator limit stop abuts the projecting tab to prevent depression of the dispenser actuator. The dispenser actuator may further include a rotation locking member configured to be biased into the actuation enabling clearance when the dispenser actuator is in the second position; and wherein the rotation locking member abuts a locking edge of the actuation enabling clearance that prevents rotation of the dispenser actuator unless the rotation locking member is depressed out of abutment with the locking edge while the dispenser actuator is rotated.

DETAILED DESCRIPTION OF THE DRAWINGS

Figure 1C:
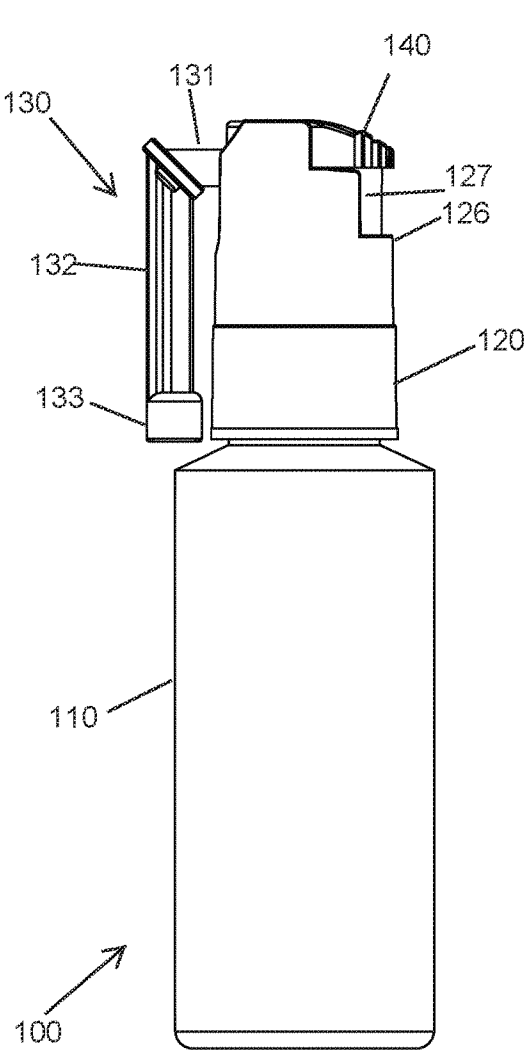
FIG. 1C shows a side view of a dispensing assembly in a retracted and unlocked position according to an embodiment of the present application.

The nozzle and dispensing assembly of the present application will be described with reference to FIGS. 1A-7.

The present application relates to a dispensing assembly 100 and a foldable nozzle 130 for use therewith. The nozzle 130 is configured to be rotatable between a horizontal position for dispensing a substance in a container 110 and a vertical position, which compacts the dispensing assembly 100 for storage and shipping. The dispensing assembly 100 may also be provided with one or more child resistant mechanisms to prevent the dispensing of a substance from the container 110 when the dispensing assembly 100 is in one or more of the child resistant locked configurations.

In various embodiments, the dispensing assembly 100 may include a container 110, such as a bottle, for housing a substance. While the embodiments discussed herein primarily identify the substance as a fluid, the dispensing assembly 100 can be used for gases, liquids, solids, foams, gels, mists, aerosols, and the like, to be dispensed from a container, without being limited to a fluid or particular fluid. The nozzle 130 may be used to dispense a spray stream, droplets, or a steady flow of the substance to be dispensed, and other variations of dispensing. The dispensing assembly 100 also comprises a cap body 120 secured to the container 110, which closes the container 110 and houses a dispensing assembly. A folding nozzle 130 is also included as part of the dispensing assembly 100, which is able to dispense the substance in the container 110 from a first, horizontal position, and can be folded into a vertical position when not being used for dispensing the substance. The dispensing assembly 100 may further comprise a dispenser actuator 140 for actuating the dispensing mechanism of the dispensing assembly 100, which can be a child resistant or non-child resistant actuator.

The nozzle 130 includes a nozzle base 131, a nozzle body 132, and a dispenser 133. The nozzle base 131 has a mounting end 139 that is mounted to the dispensing assembly 100 at a discharge port 115 arranged within the cap body 120, where it receives fluid from the container 110 into a nozzle base channel 134*b*. A circumferential bead 138 is provided on the nozzle base mounting end 139 to further secure the nozzle base 131 to the dispensing assembly 100 around the discharge port 115. In various embodiments of the dispensing assembly 100, the nozzle base 131 may be integrally formed with the dispenser actuator 140 as a part of the dispenser actuator 140, such as by plastic molding, rather than being a detachable element from the dispenser actuator 140. The nozzle body 132 is elongated and includes a nozzle body channel 134*a* therethrough for transporting the dispensing fluid to the dispenser 133. The dispenser 133 includes an opening through which the fluid is dispensed. In various embodiments of the dispensing assembly 100 and nozzle 130, an insert assembly 135 can be provided inside and/or covering the dispenser 133 opening, in order to modify the manner in which the fluid is dispensed from dispenser 133. The insert assembly 135 may comprise on the circumference a connector ring 135*a* configured to snap the insert assembly in place within the dispenser 133, which may have a corresponding circumferential element on the interior to engage the connector ring 135*a*. The insert assembly 135 may also include a locking element include a sealing element with a flat post 135*b*.

The nozzle body 132 includes a nozzle body connector 136 at which the nozzle body 132 is secured to the nozzle base 131. A nozzle base distal end 137 opposite the mounting end 139 connects to the nozzle body connector 136, forming a connection joint between them. The nozzle body connector 136 and nozzle base distal end 137 each comprise a beveled edge that is formed with an angle (Θ) relative to a longitudinal axis 143 of the dispensing assembly 100 that is in between the perpendicular and parallel. In the embodiments shown in the Figures, the nozzle body connector 136 and nozzle base distal end 137 are each formed at an angle (Θ) of approximately 45° in a complementary manner so that they abut each other flush as shown in the Figures. The nozzle body connector 136 includes a circumferential clamping member 136*a* and the nozzle base distal end 137 includes an extended circumferential edge 137*a* that is configured to be inserted into the circumferential clamping member 136*a* and snap the nozzle base distal end 137 into the nozzle body connector 136. As shown for example in FIGS. 2C, 3C, and 4D, a surface of the of the nozzle body connector 136 abuts a surface of the nozzle base distal end 137 while the circumferential edge 137*a* is disposed in between that surface of the nozzle body connector 136 and the circumferential clamping member 136*a* to secure the components together. The nozzle body connector 136 further comprises a cavity 136*c* that is configured to receive a cylindrical extension 137*c* from the nozzle base distal end 137 including the intermediary channel 134*c* therein.

The surface of the nozzle body connector 136 that abuts the nozzle base distal end 137 comprises a semicircular or arcuate slot 136*b*, shown for example in FIGS. 5B, 6B, 6D, and 6G. In the embodiments of the nozzle 130 illustrated in the Figures, the slot 136*b* is approximately semicircular and spans approximately 180° of the surface of the nozzle body connector 136, but in other embodiments, the slot 136*b* may comprise different radial lengths between 0° and 360° allowing the nozzle 130 to rotate in other angular variations. The surface of the nozzle base distal end 137 comprises a cylindrical post 137*b*. The cylindrical post 137*b* may be located outside of the center of the surface of the nozzle base distal end 137 as shown in the Figures. The cylindrical post 137*b* is configured to be received in the slot 136*b*, and the slot 136*b* has a width substantially corresponding to the diameter of the cylindrical post 137*b* for receiving the cylindrical post 137*b* therein and allowing movement of the cylindrical post 137*b* through the slot 136*b*. The slot 136*b* may further include ends that taper before expanding into rounded stops 136*d*, 136*e* that are dimensioned for retaining the cylindrical post 137*b*, as shown for example in FIG. 6G.

Figure 1B:
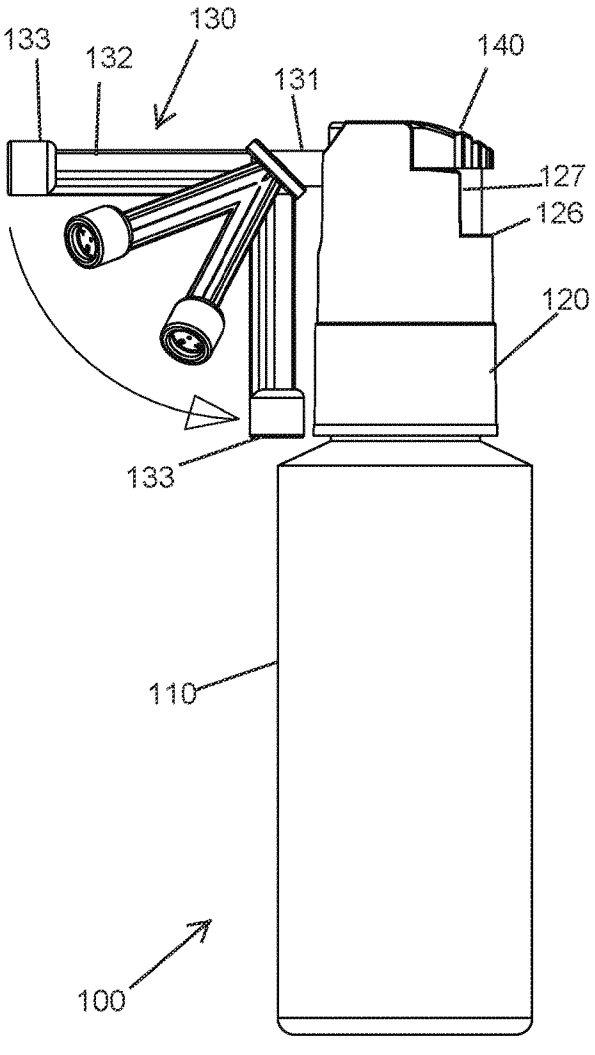
FIG. 1B shows a side view of a dispensing assembly transitioning from an extended to a retracted position according to an embodiment of the present application.
Figure 1A:
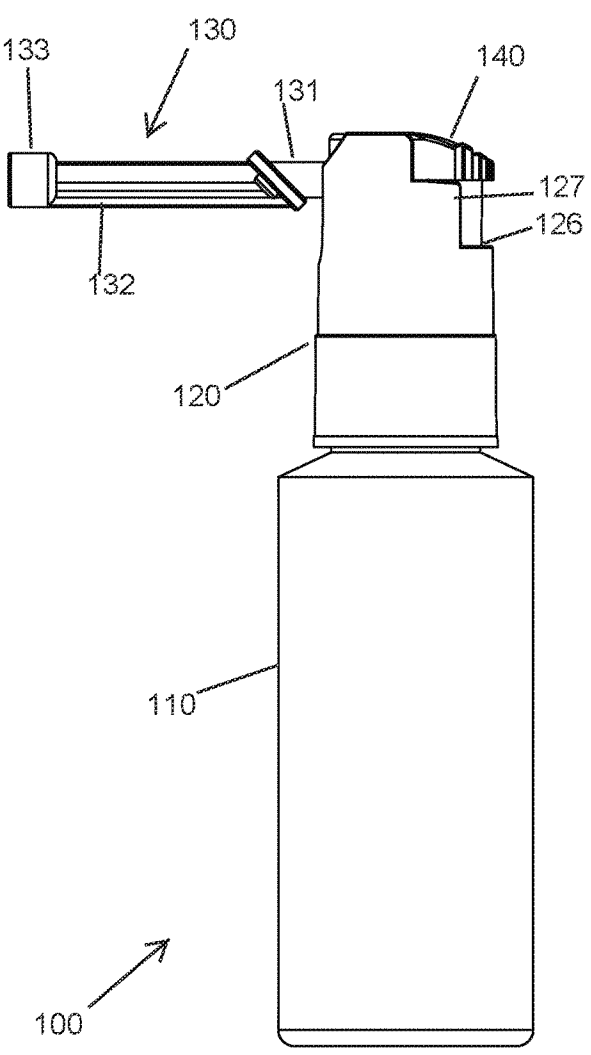
FIG. 1A shows a side view of a dispensing assembly in an extended and unlocked position according to an embodiment of the present application.

As the nozzle base 131 is mounted to the dispensing assembly 100 in a substantially fixed position, the cylindrical post 137*b* remains in a fixed location. The nozzle body 132 can be rotated about the nozzle base 131, as shown in FIGS. 1A-1C, wherein the slot 136*b* moves around the fixed cylindrical post 137*b* on the nozzle base 131. Given the angled connection of the nozzle base 131 and the nozzle body 132, when the cylindrical post 137*b* is disposed in one end of the slot 136*b* at one of the stops 136*d*, 136*e*, the nozzle body 132 is perpendicular to the longitudinal axis 143 of the dispensing assembly 100 and is in a dispensing position (FIG. 1A). As the cylindrical post 137*b* is moved through the slot 136*b* (FIG. 1B), the nozzle body 132 comes out of this perpendicular orientation until the cylindrical post 137*b* reaches the other of the two stops 136*d*, 136*e*, at which point the nozzle body 132 is parallel to the longitudinal axis 143. The nozzle body 132 can be alternated between the two horizontal and vertical positions, as shown in FIGS. 1A-1C, depending on whether the dispensing assembly 100 is in use or not in use.

In alternate embodiments of the nozzle 130, the arrangement of elements at the connection joint comprising the nozzle body connector 136 and nozzle base distal end 137 can be inverted from that previously described, that is the nozzle body connector 136 could include one or more of elements corresponding to a circumferential edge 137*a*, cylindrical post 137*b*, and/or cylindrical extension 137*c*, and the nozzle base distal end 137 could include one or more of the elements corresponding to the circumferential clamping member 136*a*, slot 136*b*, cavity 136*c*, and/or rounded stops 136*d*, 136*e*.

Figure 2A:
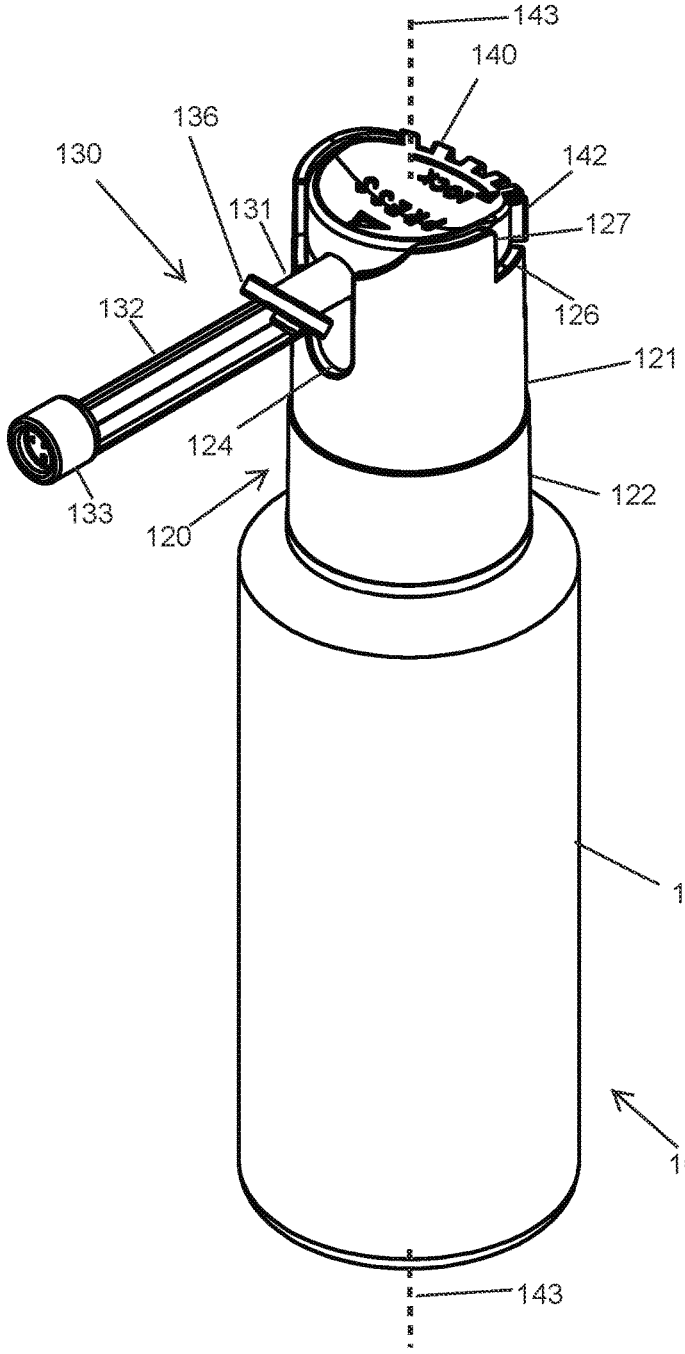
FIG. 2A shows a perspective view of a dispensing assembly in an extended and unlocked position according to an embodiment of the present application.
Figure 2B:
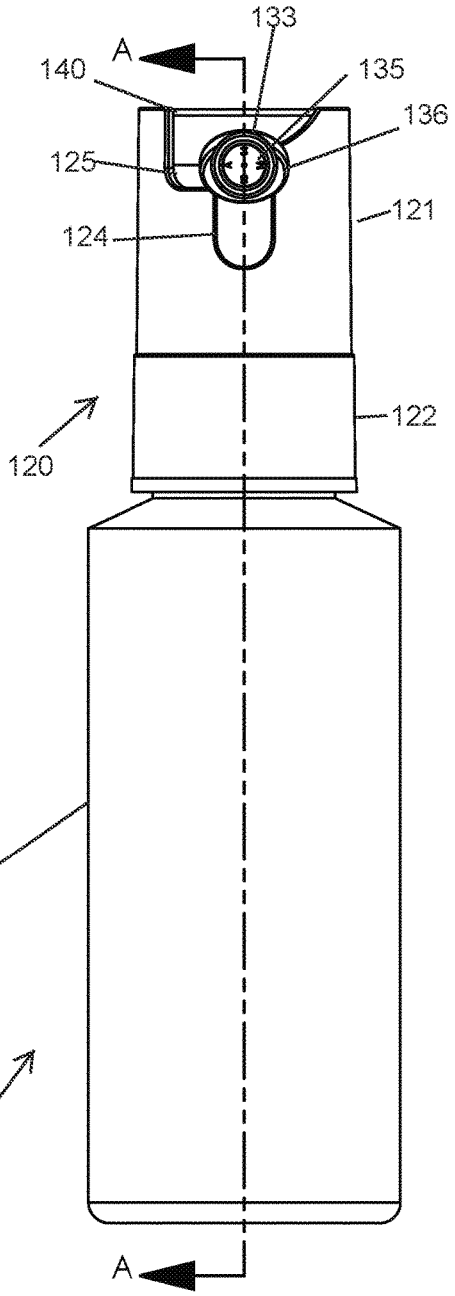
FIG. 2B shows a front view of a dispensing assembly in an extended and unlocked position according to an embodiment of the present application.
Figure 2C:
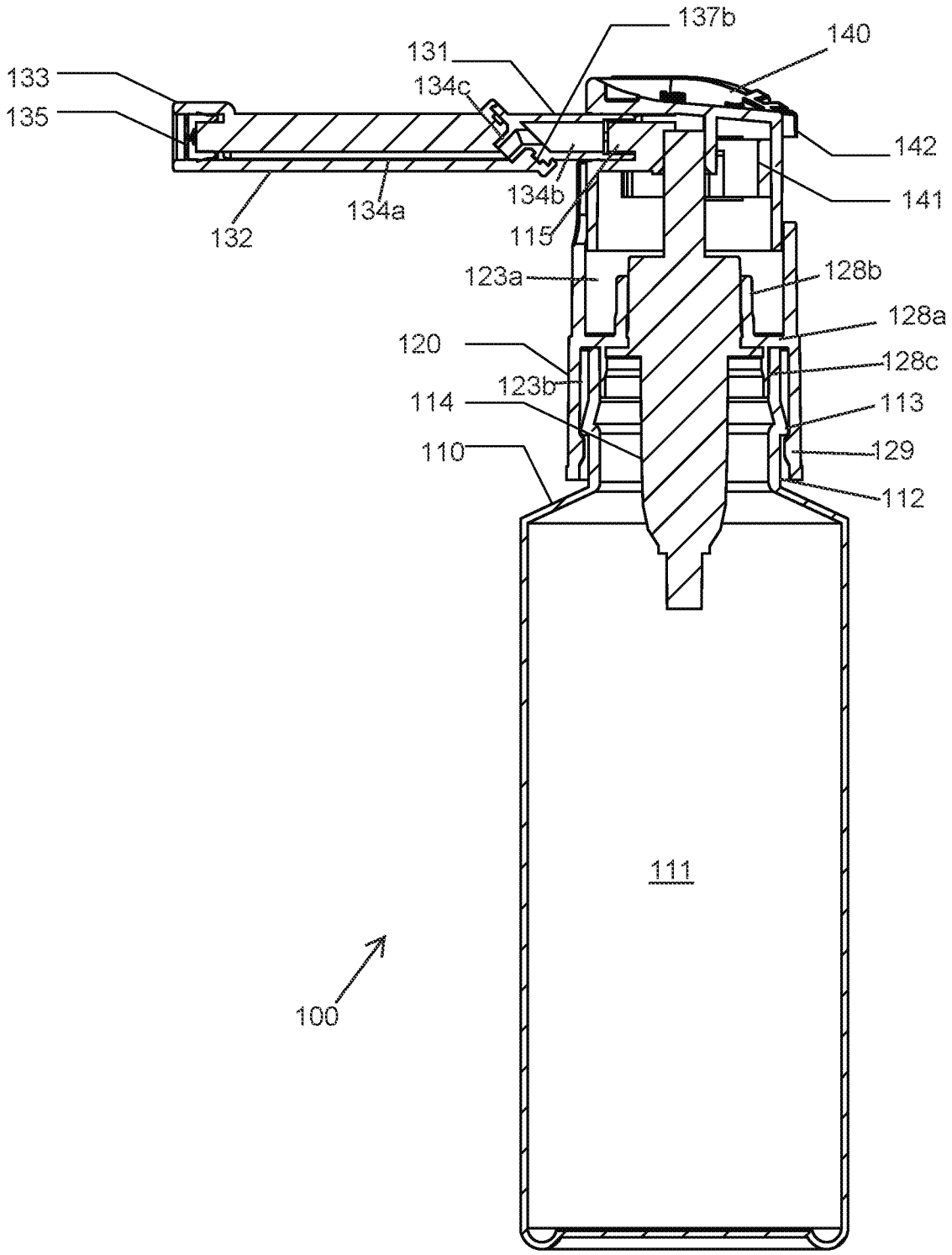
FIG. 2C shows a cross-sectional view of a dispensing assembly in an extended and unlocked position according to an embodiment of the present application.
Figure 2D:
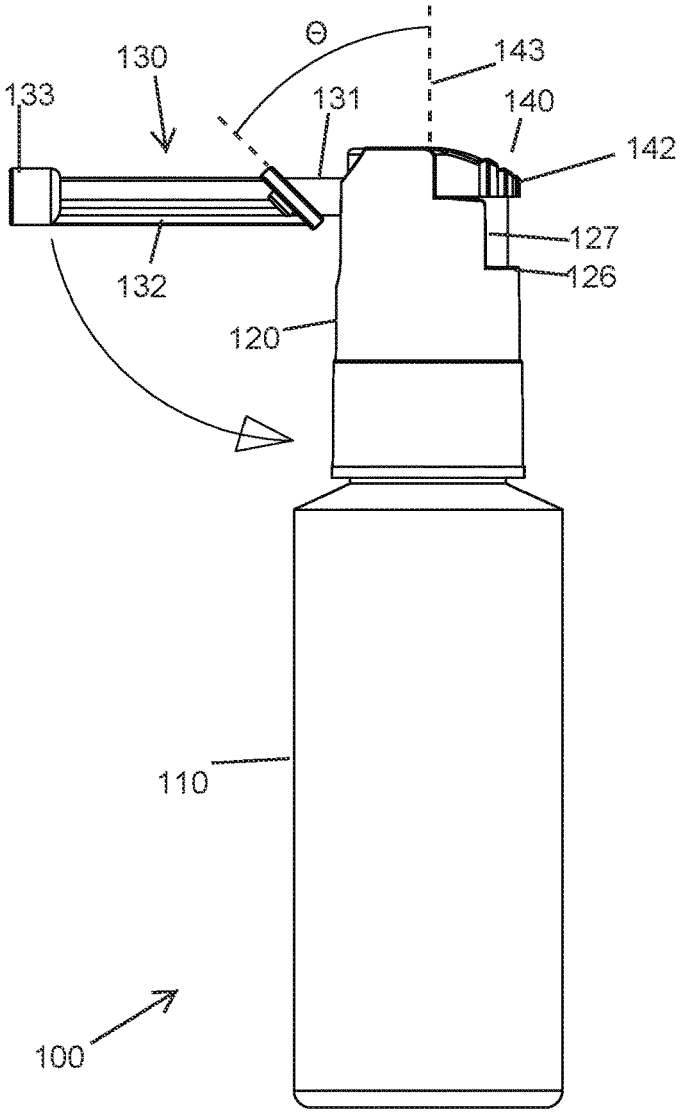
FIG. 2D shows a side view of a dispensing assembly in an extended and unlocked position according to an embodiment of the present application.
Figure 2E:
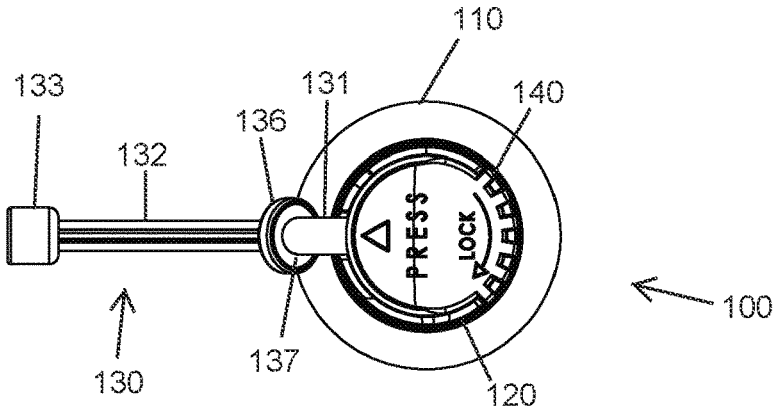
FIG. 2E shows a top view of a dispensing assembly in an extended and unlocked position according to an embodiment of the present application.
Figures 3A, 3B:
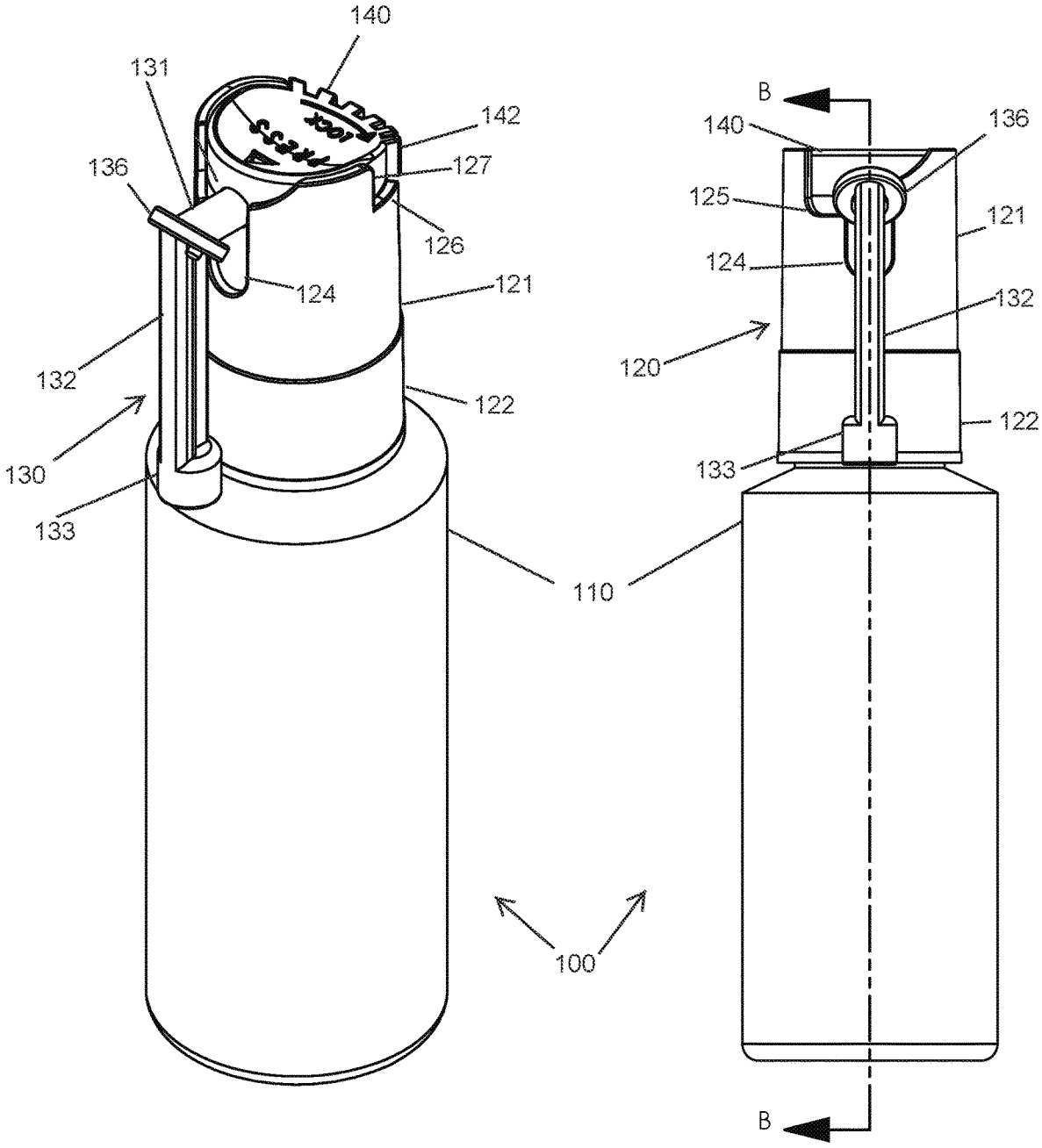
FIG. 3A shows a perspective view of a dispensing assembly in a retracted and unlocked position according to an embodiment of the present application.
FIG. 3B shows a front view of a dispensing assembly in a retracted and unlocked position according to an embodiment of the present application.
Figure 3C:
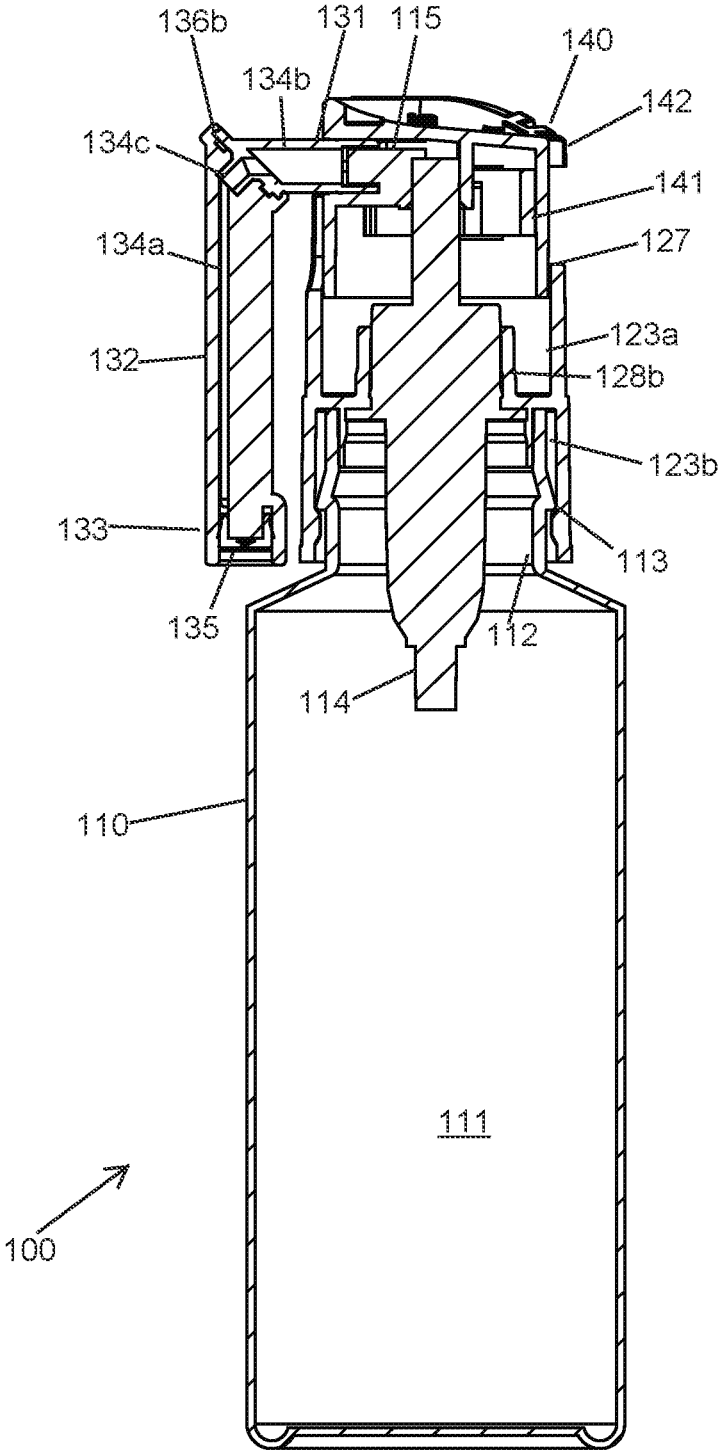
FIG. 3C shows a cross-sectional view of a dispensing assembly in a retracted and unlocked position according to an embodiment of the present application.
Figure 3D:
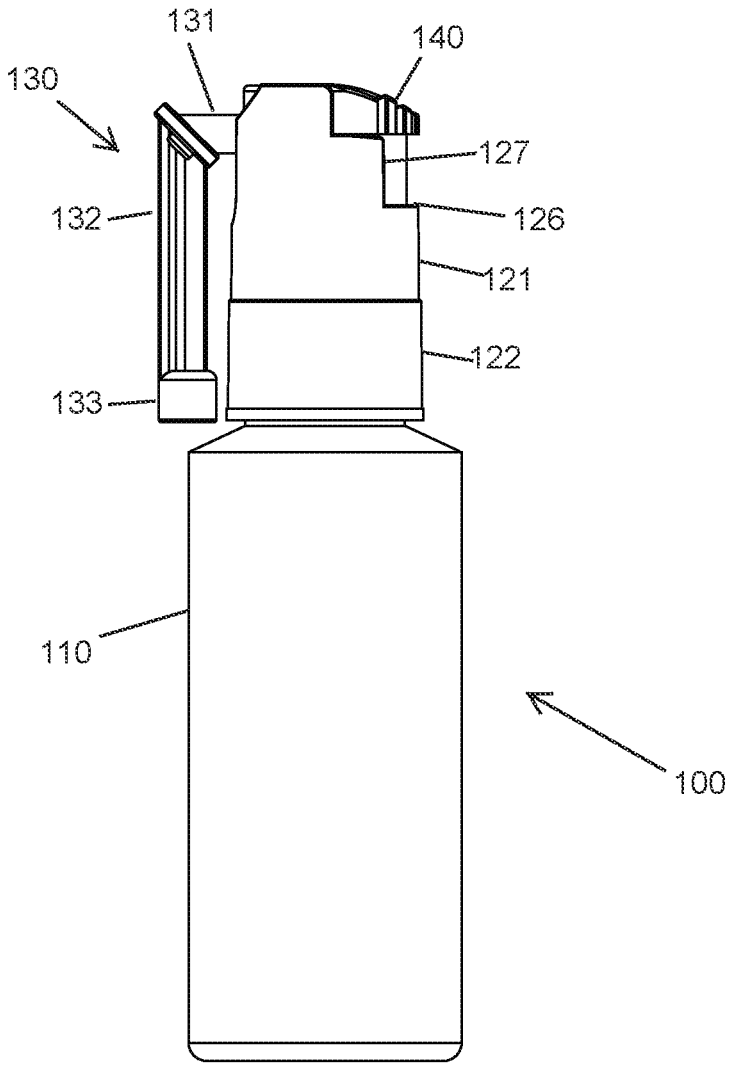
FIG. 3D shows a side view of a dispensing assembly in a retracted and unlocked position according to an embodiment of the present application.
Figure 3E:
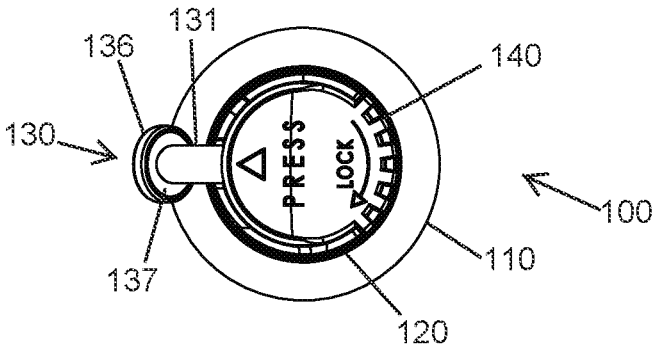
FIG. 3E shows a top view of a dispensing assembly in a retracted and unlocked position according to an embodiment of the present application.
Figure 4A:
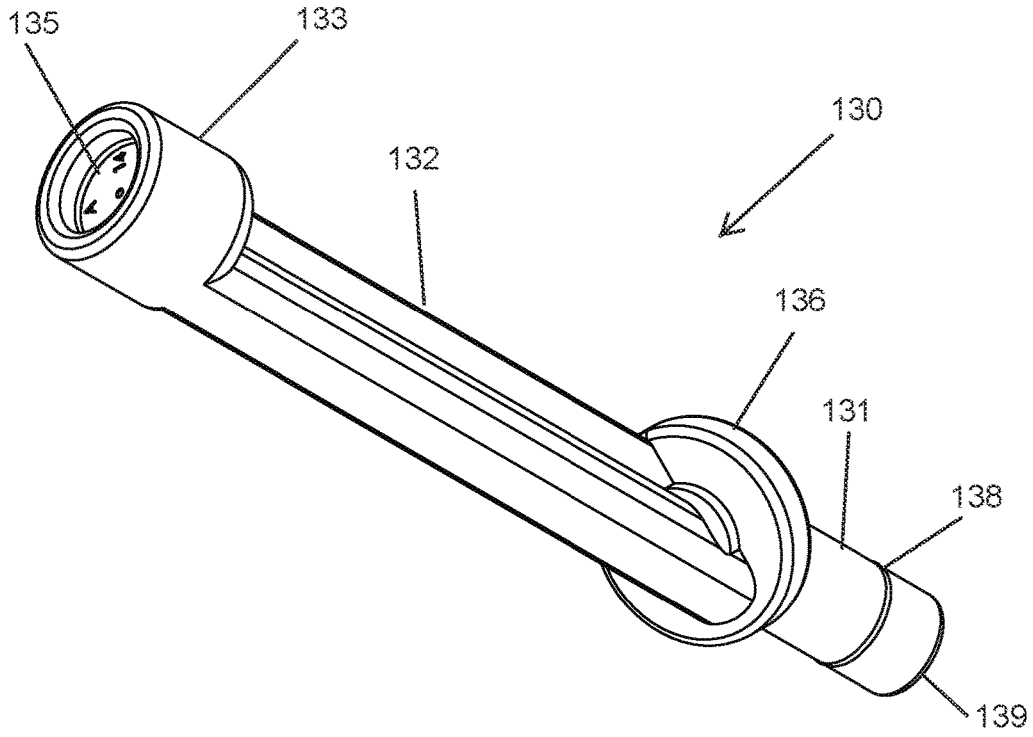
FIG. 4A shows a perspective view of a nozzle including nozzle base according to an embodiment of the present application.
Figure 4B:
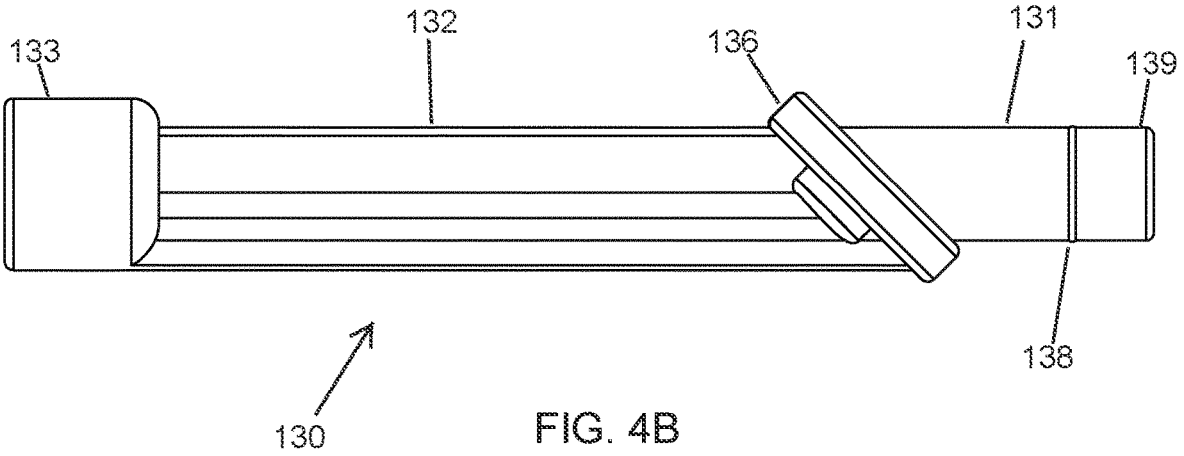
FIG. 4B shows a side view of a nozzle including nozzle base according to an embodiment of the present application.
Figure 4C:
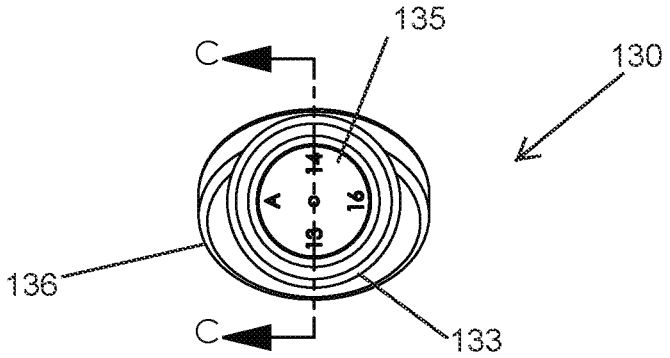
FIG. 4C shows a front view of a nozzle including nozzle base according to an embodiment of the present application.
Figure 4D:
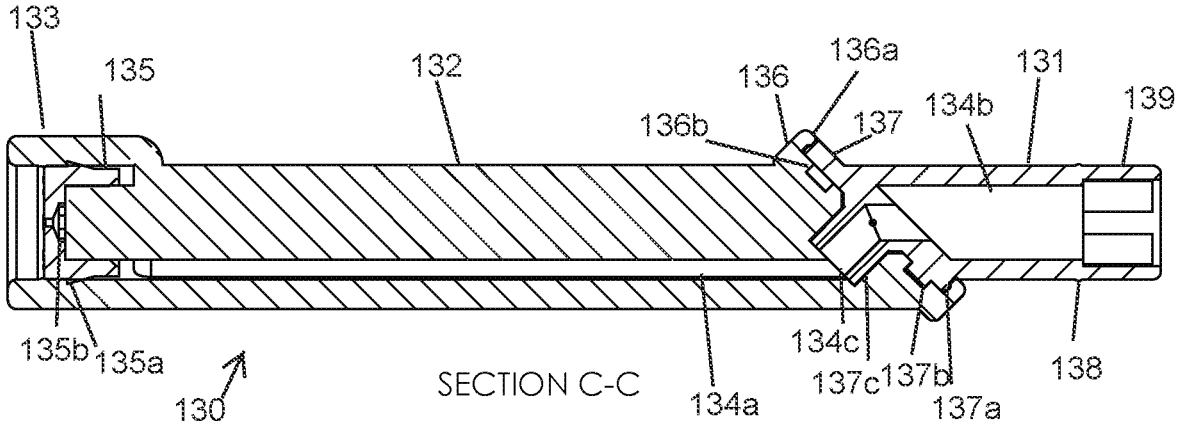
FIG. 4D shows a cross-sectional view of a nozzle including nozzle base according to an embodiment of the present application.
Figure 5A:
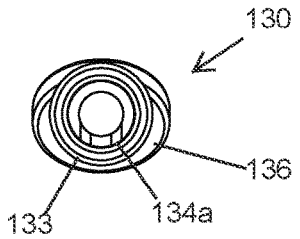
FIG. 5A shows a front end view of a nozzle according to an embodiment of the present application.
Figure 5B:
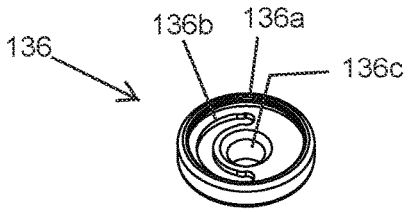
FIG. 5B shows a perspective view of a nozzle base according to an embodiment of the present application.
Figure 6A:
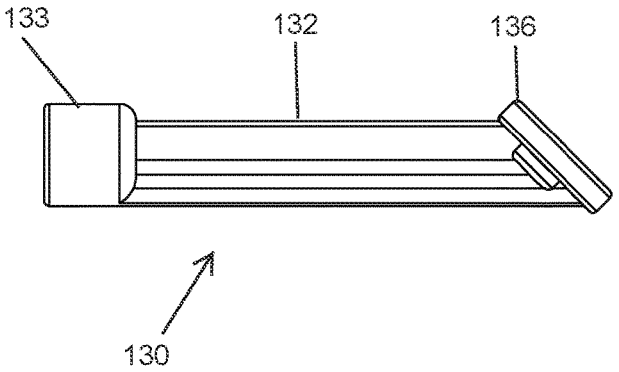
FIG. 6A shows a side view of a nozzle according to an embodiment of the present application.
Figure 6B:
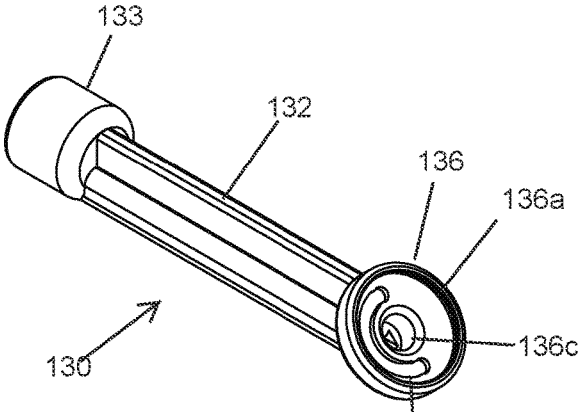
FIG. 6B shows a first, perspective view of a nozzle according to an embodiment of the present application.
Figure 6C:
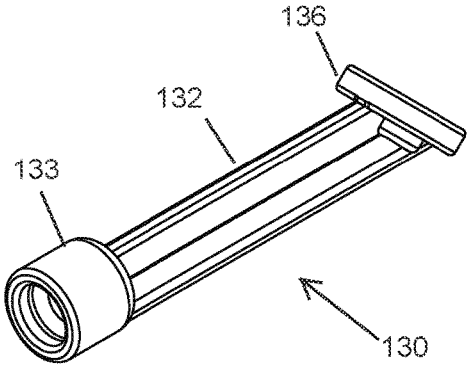
FIG. 6C shows a second, perspective view of a nozzle according to an embodiment of the present application.
Figure 6D:
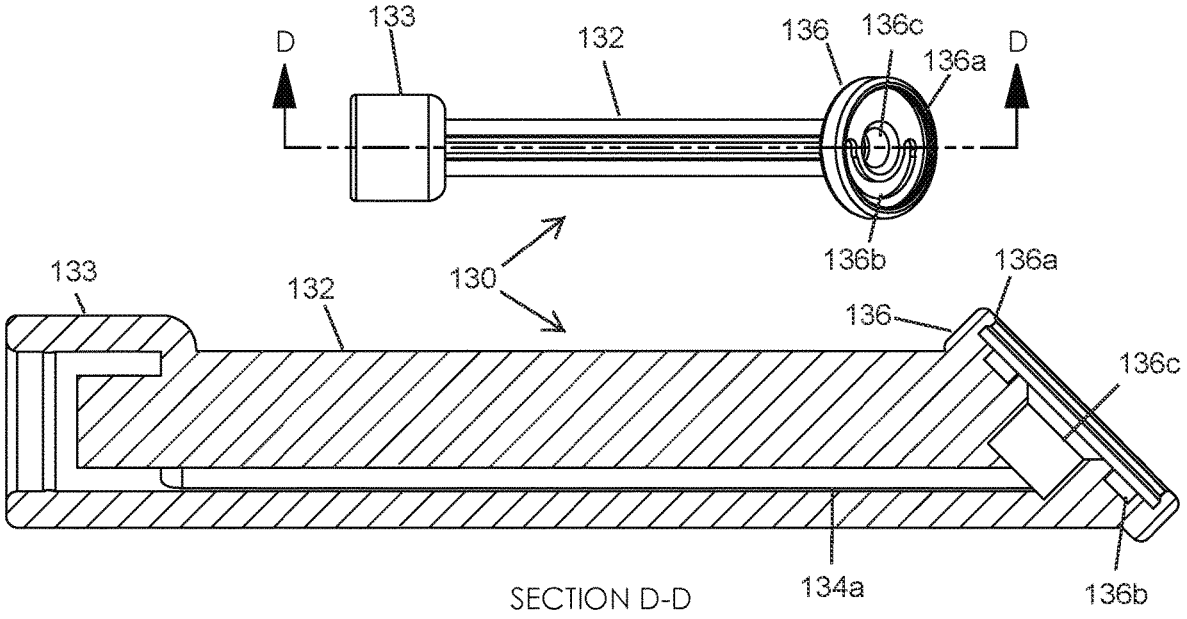
FIG. 6D shows cross-sectional view of a nozzle according to an embodiment of the present application.
Figure 6E:
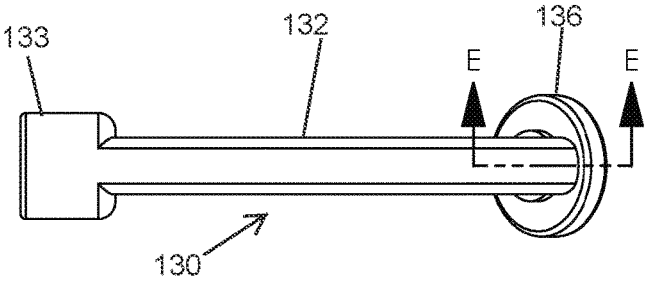
FIG. 6E shows a cross-sectional view of a nozzle base according to an embodiment of the present application.
Figure 6E:
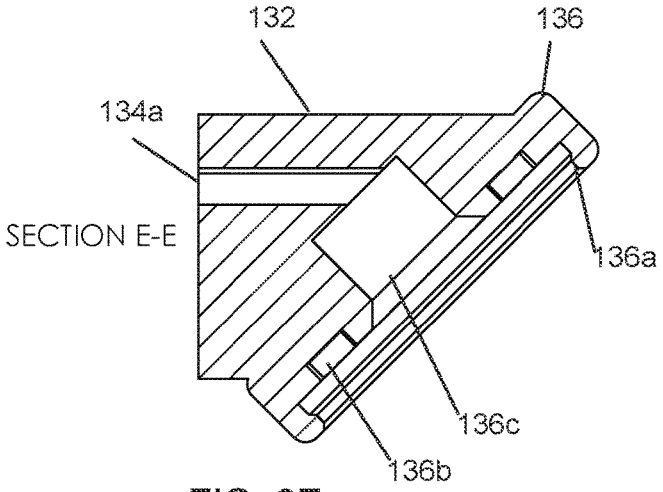
Figure 6F:
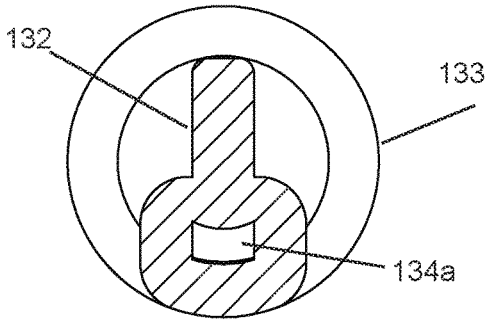
FIG. 6F shows a further cross-sectional view of a nozzle according to an embodiment of the present application.
Figure 6G:
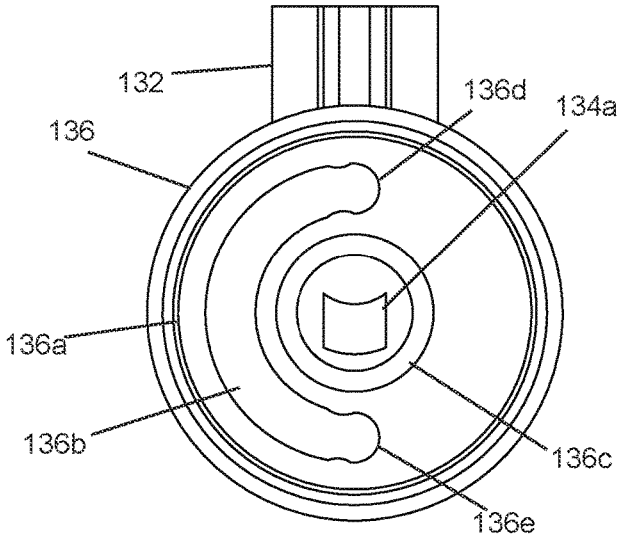
FIG. 6G shows an end view of a nozzle from the base according to an embodiment of the present application.
Figure 6H:
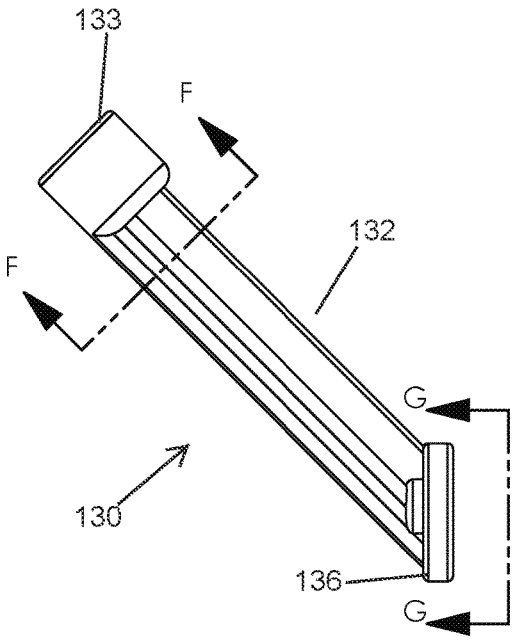
FIG. 6H shows a side view of a nozzle from the base according to an embodiment of the present application.
Figure 6I:
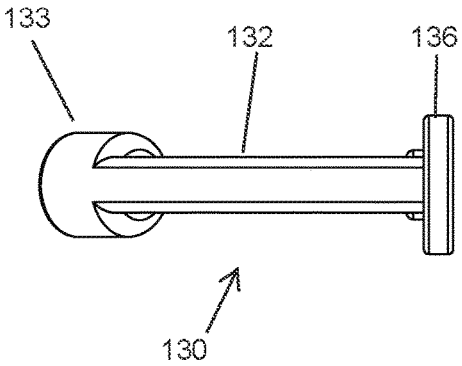
FIG. 6I shows a top view of a nozzle from the base according to an embodiment of the present application.

The cap body 120 comprises a vertical channel 124 that is cut out of the upstanding wall 121 directly beneath the nozzle 130 when the nozzle 130 is in the unlocked position shown for example in FIGS. 2A and 2B. The vertical channel 124 allows the nozzle 130 to be depressed without interference by the cap body 120, and when depressed, the nozzle base 131 passes through the vertical channel 124.

In various embodiments, the cap body 120 also comprises a horizontal channel 125 that is cut out of a top portion of the upstanding wall 121 perpendicular to the vertical channel 124. The horizontal channel 125 is positioned adjacent to the nozzle 130, when the nozzle 130 is in the unlocked position shown for example in FIGS. 2B and 3B. When the dispenser actuator 140 and nozzle 130 are rotated, the nozzle base 131 moves into the horizontal channel 125 and out of the vertical channel 124. If a user then attempts to depress the dispenser actuator 140 to dispense the substance, the nozzle base 131 comes into contact a wall of the horizontal channel 125 and prevents the dispenser actuator 140 from being depressed and prevents the substance in the container 110 from being dispensed. The horizontal channel 125 thereby provides a locking mechanism for the dispensing assembly 100, by which the user can rotate the nozzle 130 into the horizontal channel 125 to prevent the dispensing of a substance. The horizontal channel 125 can be used as a locking mechanism in combination with the child resistant locking features on the opposite side of the dispensing assembly 100, such as the combination of actuator limit stop 127, locking member 141, and projecting locking feature or tab 142, which are described in further detailed below, and as shown in the Figures. In other embodiments, the horizontal channel 125 may be included as a dispensing locking mechanism without including the additional locking features on the opposite side of the dispensing assembly 100.

The nozzle 130 can be rotated between the vertical and horizontal position when the nozzle base 131 is in either the vertical channel 124 and the horizontal channel 125, such that the nozzle 130 can be collapsed to the vertical position to make the dispensing assembly 100 more compact for storage and packaging, while also placed in a locked position that prevents the dispensing of any substance in the container 110. Further, in certain embodiments, such as those illustrated in the Figures, the length of the nozzle 130 can be the same as or shorter than the overall height of the cap body 120. As a result, when such nozzle 130 and cap body 120 are used in combination with a container 110 having a greater diameter than the cap body 120, this arrangement also prevents the nozzle 130 from being depressed, even in an unlocked position, by abutting a surface of the container 110, as shown for example in FIG. 1C.

The dispensing assembly 100 may further includes a dispenser actuator 140 disposed within a cap body 120 and configured for operation in two directions of motion: a first, sliding motion along a longitudinal axis; and a second, rotational motion about the longitudinal axis. As a result of these motions relative to the cap body 120, a dispensing mechanism is actuated to dispense a liquid product stored within the container 110. The liquid product is dispensed from the discharge port 115 of the dispensing assembly 100 throughout the dispensing stroke of the dispenser actuator 140. The nozzle 130 mates with the discharge port 115 at the mounting end 139 of the nozzle base 131 and is in fluid communication with the discharge port 115. Dispensed fluid is provided from the discharge port 115 through the nozzle base channel 134*b*, then through the intermediary channel 134*c*, before passing through the nozzle body channel 134*a* and being dispensed through the dispenser 133 of the nozzle 130.

The dispensing assembly 100 may further include a pump 114 for drawing up the fluid to be dispensed. The pump 114 extends into the chamber 111 of the container 110 and may further include a straw or tube (not shown) extending from its base into the container 110 to draw up the fluid from lower in the chamber 111. The pump 114 is primarily disposed in the cap body 120. Within the cap body 120, a floor member 128*a* is provided proximal to the base portion upper edge 122*a*, and an upright cylinder 128*b* is situation on the floor member 128*a*, extending into an upper chamber 123*a* of the cap body 120. The pump 114 is inserted through the upright cylinder 128*b*, as shown for example in FIGS. 2C and 3C. An upper portion of the pump 114 is in fluid connection with the discharge port 115 adjacent to the dispenser actuator 140. The lower portion of the pump 114 is disposed beneath the floor member 128*a* and is situated within the neck 112 of the container 110. Although a pump 114 is shown in the Figures, it is noted that the dispensing assembly 100 can include and the nozzle 130 used with any type of pump or dispensing system, such as pump dispensers, metered aerosol dispensers or continuous spray aerosol dispensers.

The container 110 includes a neck 112 that is configured to be received in a lower chamber 123*b* of the cap body 120 and secured to the cap body 120 therein. In the embodiment of the dispensing assembly 100 shown in the Figures, the container neck 112 has a circumferential locking element 113 that is configured to engage a circumferential bead 129 inside the base portion 122 of the cap body 120, by snapping over the circumferential bead 129 so as to secure the container 110 to the cap body 120. A circular sealing member 128*c* extends from the floor member 128*a* within the cap in a direction opposing the upright cylinder 128*b* and is received within the neck 112 of the container 110 to form a seal around the opening of the neck 112 to prevent the inadvertent leakage of fluid from the container 110.

Figure 7:
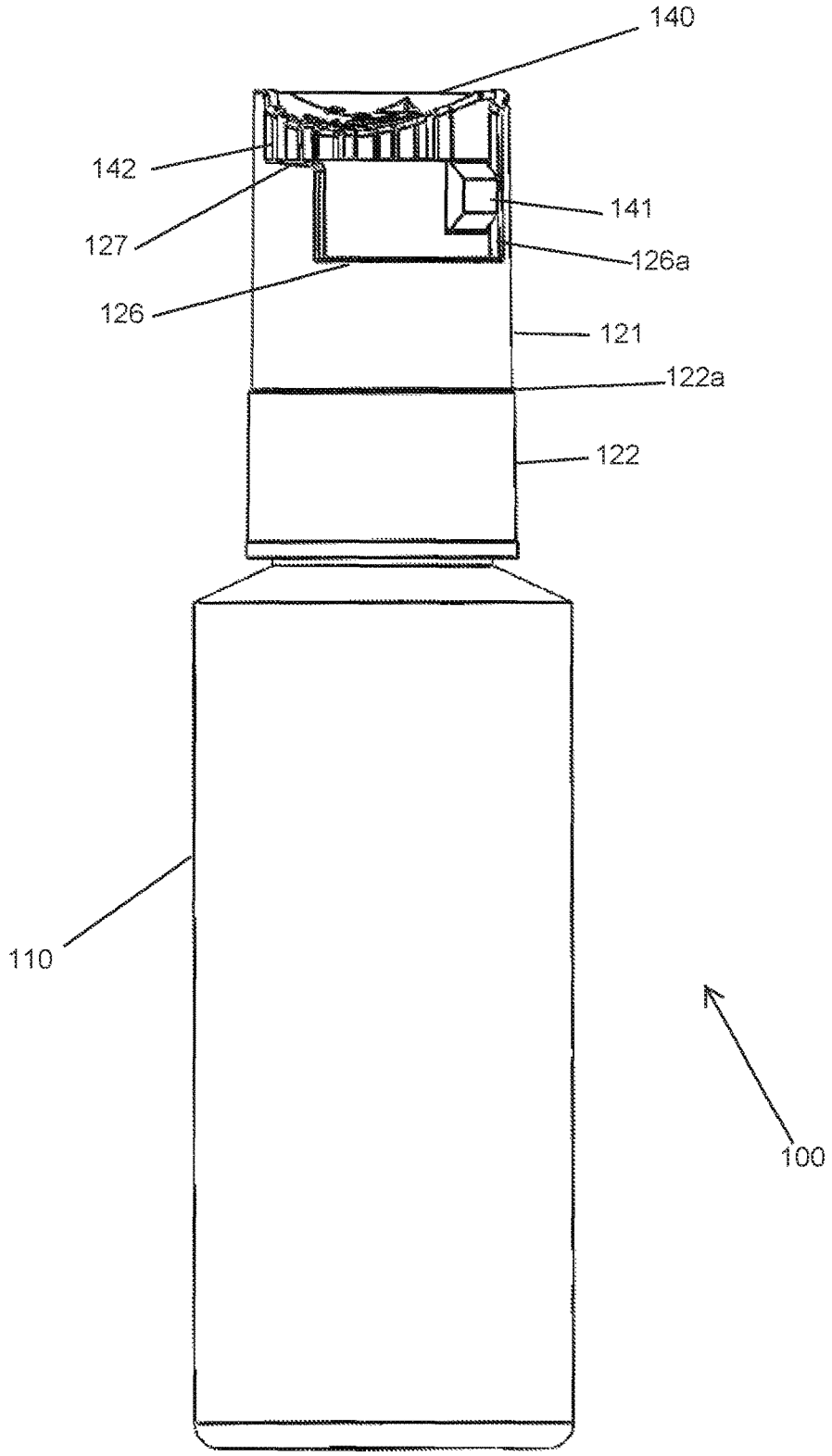
FIG. 7 shows a rear view of a dispensing assembly in a locked position according to an embodiment of the present application.

The cap body 120 may be cylindrical and includes a base portion 122 and an upstanding wall 121. The base portion 122 has a height spanning between a bottom edge of the cap body 120 and a base portion upper edge 122*a*. The upstanding wall 121 extends upward from the base portion upper edge 122*a*. The upstanding wall 121 is generally cylindrical in shape, having a thin wall and a plurality of relief cuts formed therein. The upstanding wall 121 is bounded between an upstanding wall top edge and the base portion upper edge 122*a*. The upstanding wall 121 includes a first relief cut that extends from the upstanding wall top edge towards the base portion upper edge 122*a* to thereby form a horizontally arranged actuator limit stop 127. The actuator limit stop 127 prevents downward movement of the rotating dispenser actuator 140 when the rotating dispenser actuator 140 is rotated into a locked configuration as indicated by locking rotational motion. Actuator limit stop 127 provides an actuation governing engagement edge that is configured to engage with a portion of the rotating dispenser actuator 140 when rotated into a locked state. The rotating dispenser actuator 140 includes a projecting locking feature 142 outwardly extending from an upper edge of the rotating dispenser actuator 140. The projecting locking feature 142 may project from an actuating surface of the dispenser actuator 140 is designed to engage with the actuation governing engagement edge when rotated into a locked position, as shown in FIG. 7, and disengage therefrom when rotated into an unlocked, dispensing position as shown in FIGS. 1-2. The upstanding wall 121 further includes a second relief cut that extends from the upstanding wall top edge towards the base portion upper edge 122*a* to thereby form an actuation enabling clearance 126 which provides a recess for a portion of rotating dispenser actuator 140 when rotated into an unlocked position. The user must depress a rotation locking member 141 wherein that rotation locking member 141 becomes displaced behind the upstanding wall 121, enabling the rotation locking member 141 to be rotated past the push-button locking edge 126*a*. This enables the rotating dispenser actuator 140 to be rotated into the unlocked state. The rotation locking member 141 is preferably biased outwardly (i.e., towards upstanding wall 121), such that when the rotating dispenser actuator 140 is rotated into the locked position shown in FIG. 7, the rotation locking member 141 will be biased outwardly into the actuation enabling clearance 126. Alternatively, the locking member 141 may be in a fixed position and biased through an opening in a wall of the dispenser actuator 140 beneath and adjacent to the projecting locking feature 142 such that it prevents the dispenser actuator 140 from rotating in the biased position, and when the locking member 141 is depressed through the opening, the dispenser actuator 140 is able to be rotated into the unlocked configuration.

In the exemplary embodiment, the first relief cut recess forming the actuator limit stop 127 transcends a longitudinal distance (as aligned with longitudinal axis 143 shown in FIG. 2A) from the upstanding wall top edge towards the base portion upper edge 122*a* to a depth point that operatively engages with the projecting locking feature 142. The actuator limit stop 127 is positioned to engage with the projecting locking feature 142 when the rotating dispenser actuator 140 is at an uppermost portion of a dispensing stroke. A second relief cut recess forming actuation enabling clearance 126 can be positioned in arcuate alignment with the first relief cut recess forming actuator limit stop 127 and circumferentially extending from one end of the first relief cut. The second relief cut transcends downward from the upstanding wall top edge a longitudinal distance (as aligned with the longitudinal axis 143) that is substantially equal to a dispensing stroke required to actuate the dispensing mechanism.

The pump dispenser actuator 140 is disposed within the cap body 120 and is configured for two directions of motion, including a first slidable movement parallel to the longitudinal axis 143 and a second rotational motion about the longitudinal axis 143. The projecting locking feature 142 is preferably configured as a plurality of rectangular blocks that extend radially outward from rotating dispenser actuator 140. The plurality of rectangular blocks provides a gripping surface for engagement with the user's finger. In an alternate embodiment, projecting locking feature 142 may be configured as a unitary protrusion. The projecting locking feature 142 may include a textured surface to provide an increased frictional interface to aid in the rotational motion.

As illustrated in the exemplary embodiment, the projecting locking feature 142 is substantially similar in arc distance to the overall arc distance of actuation enabling clearance 126. Additionally, the arc distance of projecting locking feature 142 combined with the arc distance of the rotation locking member 141 is preferably similar to the combined arc distance of the actuation enabling clearance 126 and the actuator limit stop 127. When the dispensing assembly 100 is placed into an unlocked position as illustrated in FIGS. 1-2, the rotating dispenser actuator 140 may be longitudinally depressed such that the projecting locking feature 142 is permitted to travel longitudinally within the actuation enabling clearance 126. As a result of the longitudinal displacement of rotating dispenser actuator 140 within cap body 120, a dispensing mechanism may be actuated to dispense a fluid or product stored within container 110, as previously described.

The child resistant mechanism of the dispensing assembly 100 can be similar to that described in applicant's earlier U.S. Pat. No. 8,777,061, which is hereby incorporated by reference in its entirety. The child resistant locking mechanism of the dispensing assembly 100 may additionally or alternatively be similar to those shown described in applicant's U.S. Pat. No. 10,654,051, 10,689,169, or 10,669,082, which each require a rotational movement simultaneous to a depression of a locking button to unlock a container, and which are also incorporated by reference in their entireties.

It is also to be understood that the folding nozzle and dispensing assembly described herein may be utilized without a child resistant mechanism.

As used herein, directional or positional terms such as "front", "rear", "upper", "lower", "top", "bottom", etc., are used for explanatory purposes only to describe the dispensing assembly 100 as illustrated in the figures, with the dispensing side of the dispensing assembly 100 being designated the "front" for explanatory purposes.

While there have been shown and described and pointed out fundamental novel features of the invention as applied to embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. A dispensing assembly comprising:

a cap body;

a dispenser actuator arranged at least partly within the cap body; and a dispensing nozzle comprising:

a nozzle base having a mounting end configured to be mounted to the dispenser actuator;

a nozzle body having a first end connected, at a connection joint, to a distal end of the nozzle base, the distal end being opposite the mounting end, the connection joint comprising:

a first beveled surface comprising an arcuate slot formed therein; and a second beveled surface opposing the first beveled surface and comprising a post projecting therefrom, the arcuate slot being configured to receive the post therein;

wherein the post is configured to pass through the arcuate slot such that the nozzle body is configured to rotate about the nozzle base; and a dispenser arranged at a second end of the nozzle body comprising an opening for dispensing a substance; and a container connected to the cap body and configured to house a substance to be dispensed by the dispensing assembly;

wherein the dispenser actuator is configured to be depressed into the cap body and cause a corresponding depression of the dispensing nozzle connected to the dispenser actuator and enables dispensing of the substance through the dispensing nozzle;

wherein the nozzle body is configured to rotate between a first, dispensing position and a second, storage position; and wherein when the nozzle body is in a second, storage position, the dispensing nozzle abuts a surface of the container, thereby preventing the depression of the dispenser actuator.

2. The dispensing assembly according to claim 1, wherein the first beveled surface is disposed on the first end of the nozzle body and the second beveled surface is disposed on the distal end of the nozzle base.

3. The dispensing assembly according to claim 2, wherein the distal end of the nozzle base and the first end of the nozzle body are each beveled and the arcuate slot is substantially semi-circular.

4. The dispensing assembly according to claim 3, wherein the dispenser actuator is configured to be depressed in a first longitudinal direction into the cap body and cause a corresponding depression of the dispensing nozzle connected to the dispenser actuator in the first longitudinal direction; and wherein when the nozzle body is in the second, storage position, the nozzle body is aligned in parallel to the first longitudinal direction and the dispenser is disposed adjacent to a base portion of the cap body.

5. The dispensing assembly according to claim 1, wherein the cap body comprises:

an upstanding wall comprising:

a vertical channel formed therein, the vertical channel being disposed adjacent to the nozzle base to permit depression of the dispensing nozzle through the vertical channel upon depression of the dispenser actuator; and a horizontal channel formed therein adjacent and perpendicular to the vertical channel.

6. The dispensing assembly according to claim 5, wherein the dispenser actuator is configured for rotational movement about a longitudinal axis of the dispensing assembly, and wherein the dispenser actuator is configured to rotate to position the nozzle base in the horizontal channel and the horizontal channel prevents depression of the nozzle base and dispenser actuator.

7. The dispensing assembly according to claim 1, wherein the cap body comprises an upstanding wall comprising an actuation enabling clearance formed therein; and wherein the dispenser actuator comprises an actuating surface having a projecting tab extending from an edge of the actuating surface and aligned with the actuation enabling clearance, wherein the projecting tab is configured to pass through the actuation enabling clearance when the dispenser actuator is depressed.

8. The dispensing assembly according to claim 7, wherein the upstanding wall comprises an actuator limit stop positioned in arcuate alignment with the actuation enabling clearance; and wherein the dispenser actuator is configured for rotational movement between a first position in which the projecting tab is aligned with the actuation enabling clearance and a second position in which the projecting tab is aligned with the actuator limit stop, wherein in the second position, the actuator limit stop abuts the projecting tab to prevent depression of the dispenser actuator.

9. The dispensing assembly according to claim 8, wherein the dispenser actuator further comprises a rotation locking member configured to be biased into the actuation enabling clearance when the dispenser actuator is in the second position; and wherein the rotation locking member abuts a locking edge of the actuation enabling clearance that prevents rotation of the dispenser actuator unless the rotation locking member is depressed out of abutment with the locking edge while the dispenser actuator is rotated.

10. The dispensing assembly according to claim 1, wherein the nozzle body is configured to rotate between the first, dispensing position in which the nozzle body is substantially parallel to the nozzle base and the second, storage position in which the nozzle body is substantially perpendicular to the nozzle base.

11. The dispensing assembly according to claim 1, wherein the first end of the nozzle body comprises a circumferential clamping member and the distal end of the nozzle base comprises a circumferential edge, and wherein the circumferential clamping member is configured to engage the circumferential edge.

12. The dispensing assembly according to claim 1, wherein the arcuate slot is substantially semi-circular and comprises two ends, each end comprising a rounded stop member, each rounded stop member configured to retain the post.

13. The dispensing assembly according to claim 1, wherein the nozzle body and nozzle base each comprise a channel formed therethrough, and the distal end of the nozzle base comprises a cylindrical extension formed on the second beveled surface comprising an intermediary channel formed therein configured to connect the nozzle body channel and the nozzle base channel; and wherein the first end of the nozzle body comprises a cavity formed therein to receive the cylindrical extension therein.

* * * * *